United States Patent [19]

Lederrey

[11] 4,421,423

[45] Dec. 20, 1983

[54] WATERTIGHT WRIST-WATCH CASING

[75] Inventor: Marc Lederrey, Le Landeron, Switzerland

[73] Assignee: Montres Rado S.A., Switzerland

[21] Appl. No.: 374,690

[22] Filed: May 4, 1982

[30] Foreign Application Priority Data

May 1, 1981 [CH] Switzerland ..... 2858/81

[51] Int. Cl.[3] ..... G04B 37/08; G04B 37/00

[52] U.S. Cl. ..... 368/291; 368/276; 368/281; 368/292

[58] Field of Search ..... 368/291, 281, 276, 286, 368/287, 292, 300, 309, 310

[56] References Cited

U.S. PATENT DOCUMENTS

| | | | |
|---|---|---|---|
| 3,719,038 | 3/1973 | Klingenberg | 368/280 |
| 4,015,422 | 4/1977 | Van Haaften | 368/281 |
| 4,075,828 | 2/1978 | Klingenberg | 368/292 |
| 4,136,515 | 1/1979 | Thompson et al. | 368/309 |

FOREIGN PATENT DOCUMENTS

| | | |
|---|---|---|
| 2397668 | of 1978 | France . |
| 236369 | of 1971 | Switzerland . |

*Primary Examiner*—J. V. Truhe
*Assistant Examiner*—Terry Flower
*Attorney, Agent, or Firm*—Parkhurst & Oliff

[57] ABSTRACT

The bottom of the watertight wrist-watch casing is composed of a metallic piece (1) having its edges (2) bent up at right angles, and of a thin elastomer layer (3) lining the inner face of piece (1), to which it strongly adheres by means of a metal/elastomer junction. This bottom is secured to the caseband (9) by means of screws (24) which cause the bottom edges (2) to bear against the caseband (9), thereby pressing the thicker periphery of layer 3 against the caseband (9), to form a tight seal between the bottom and the caseband.

The layer (3) is molded with two projections (6) serving as a substitute for the conventional case screws, and with four pillars (7) which hold the dial (18) in abutting engagement with the bottom of a lodging (17).

6 Claims, 6 Drawing Figures

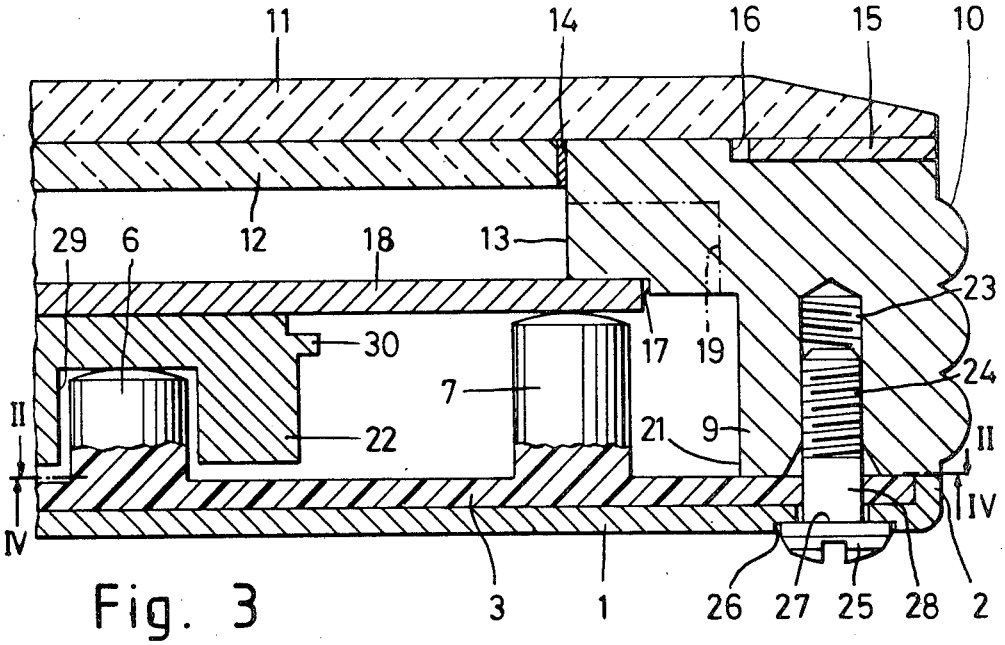
Fig. 3
Fig. 4
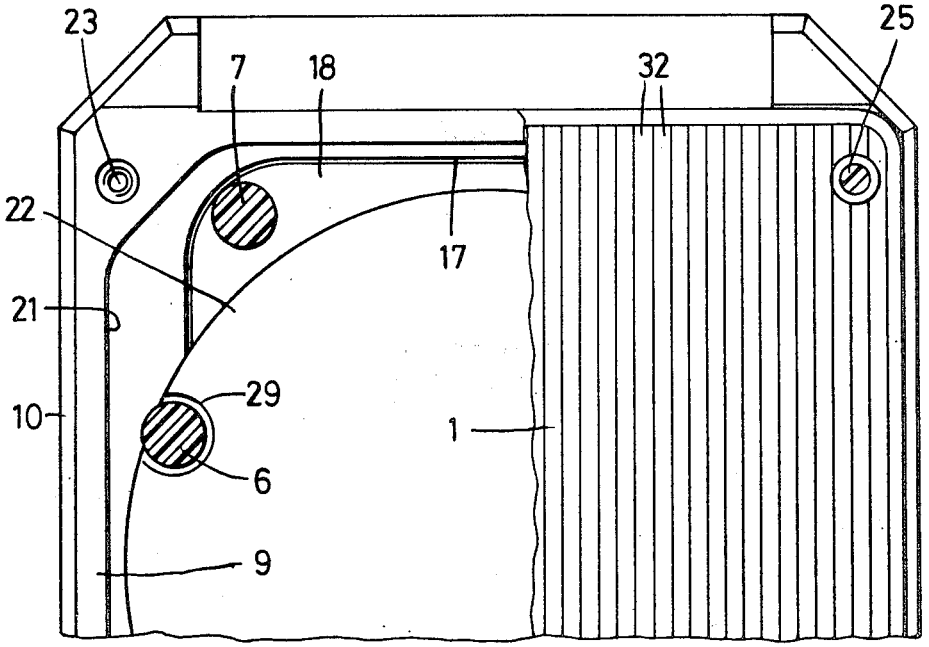

WATERTIGHT WRIST-WATCH CASING

BACKGROUND OF THE INVENTION

1. Field of the invention

This invention relates to watertight wrist-watch casings particularly of the type including a caseband and an independent bottom removably secured to said caseband by means of screws crossing the bottom and causing a thin gasket of elastomeric material to be compressed between the caseband and the bottom so as to form a tight seal between these two pieces.

2. Description of the prior art

With the casings of that type, which are known in the art, the gasket is an independent piece which accordingly must be set in place separately (US - A - 4 015 422).

The thinner the gasket is chosen, the more supple it must be in order to provide the proper seal. Now, setting a very supple gasket in place is not an easy task. If the gasket has been laid on the bottom of its lodging for instance of the caseband, setting the bottom in place may easily shift the gasket aside or fold it or even crumple it, thus jeopardizing the casing tightness, because once the casing is closed, the condition of the gasket can no longer be checked. Moreover, in manufacturing the gasket and the metallic casing pieces separately, the gasket will hardly fit the lodging provided for it in the metallic casing pieces in the proper manner, because of the tolerances, if the metallic casing pieces butt against each other in closed condition. Otherwise, if the bottom is pressed against the gasket without abutting against the caseband, there is a great risk of exceeding the limit of elasticity of the gasket upon securing the bottom to the caseband. Anyway, with an independent gasket a lodging for it must be formed either in the caseband or in the bottom, thus involving a manufacturing complication of the piece in question.

Casings are also known in the art in which the gasket of elastomeric material is cup-shaped and constitutes together with the glass a tight envelope in the proper metallic casing (CH - A - 2363/69). The latter is, however, not tight, so that water can seep into that casing and flow in the movement upon opening the casing for a repair.

SUMMARY OF THE INVENTION

With the casing according to the invention, the drawbacks of the known casings of that type are avoided, because the gasket of elastomeric material is rigidly joined to the metallic bottom of the casing. When closing the casing, the gasket will surely occupy the place provided for it. Moreover, it has no longer to be handled as a separate piece upon assembling the watch. The risk of exceeding the limit of elasticity of the gasket due to the tolerances is also avoided, because the formation of a metal/elastomer junction involves the polymerization of the elastomer under pressure in a closed mold and, of course, in contact with the metallic bottom piece, so that the shape and sizes of the unit obtained thereafter are as precise as if said unit had been produced on a machine tool.

The mode of joining the elastomer layer to the metallic bottom piece also enables producing casings in which the abutment of the metallic bottom piece against the caseband exactly determines the proper compression of the elastomer layer. Moreover, the latter can easily be molded with means automatically holding the watch movement in place within the casing merely upon laying the watch movement into the caseband and securing the bottom to the caseband. The glass can even be secured to the caseband at the same time.

BRIEF DESCRIPTION OF THE DRAWING

Two embodiments and some modifications are disclosed hereinafter in detail, but only by way of example, with reference to the diagrammatical showing of the accompanying drawing in which:

FIG. 3 is a cross-section along line III—III of FIG. 2, but on a larger scale and which shows the peculiarities of the first embodiment;

FIG. 4 is a view of the lower side of the watch of FIG. 2, some casing parts being torn away and other parts being shown in section in the direction of arrows IV—IV of FIG. 3;

DESCRIPTION OF THE PREFERRED EMBODIMENTS

Figure 1:
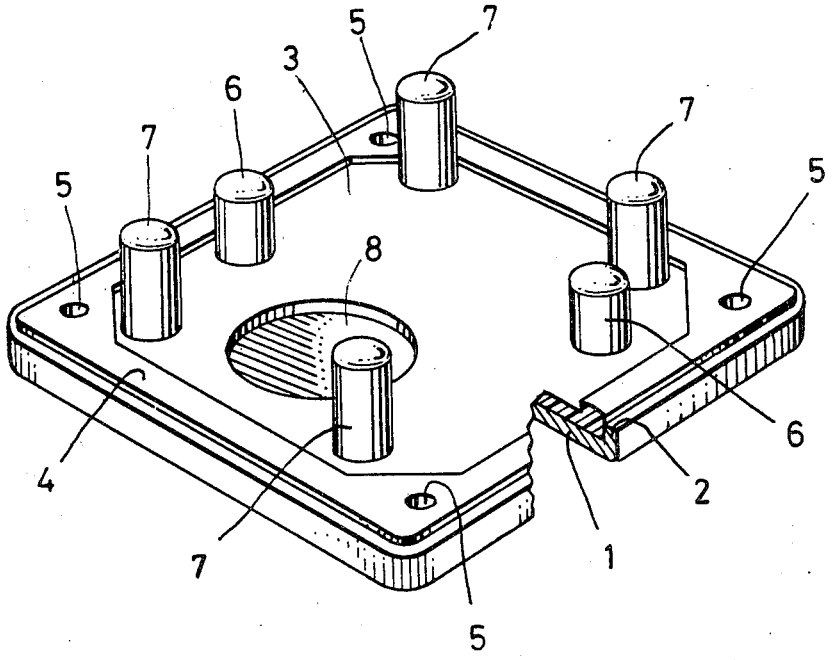
FIG. 1 is a perspective view of the bottom, which is the same in both embodiments.

The watchcase bottom represented in FIG. 1 comprises a metallic piece 1 which is generally flat. Piece 1 constitutes the outer bottom part. The edges 2 of piece 1 are bent upwards at right angles. The bottom represented also comprises a thin layer 3 of elastomeric material which lines the inner face of piece 1 to which it strongly adheres. At its periphery, layer 3 is provided with an upwardly extending rim 4 which is adjacent to the bent up edges of piece 1 and extends somewhat above said edges. Passages 5 are formed in the vicinity of the corners of the bottom, through its metallic piece 1, the layer 3 and its rim 4. Two cylindrical upwardly extending projections 6 and four pillars 7 are integral with layer 3. Finally, layer 3 is interrupted in a circular area 8, so that the inner face of piece 1 is bare at that place.

The function of projections 6, pillars 7 and area 8 will be disclosed in detail hereinafter. As regards passages 5, they are intended for the bottom fixing screws represented in the section views of the next FIGURES of the drawing.

To avoid too great variations of the cross-section of rim 4 along the bottom periphery, the triangular portions provided in the bottom corners could be reduced. It suffices, indeed, that the rim 4 surrounds the screw passages 5. The latter could also be provided nearer to the bottom corners.

As represented in FIG. 1, layer 3 together with its rim 4, the projections 6, pillars 7, the central opening 8 and the passages for the bottom fixing screws are molded in piece 1 under pressure and polymerized within the mold in order to form a metal/elastomer junction. The material commercialized under the trademark "VITON" has a particulary good adhesion to the stainless steel of piece 1 under the forming conditions disclosed of layer 3.

Figure 2:
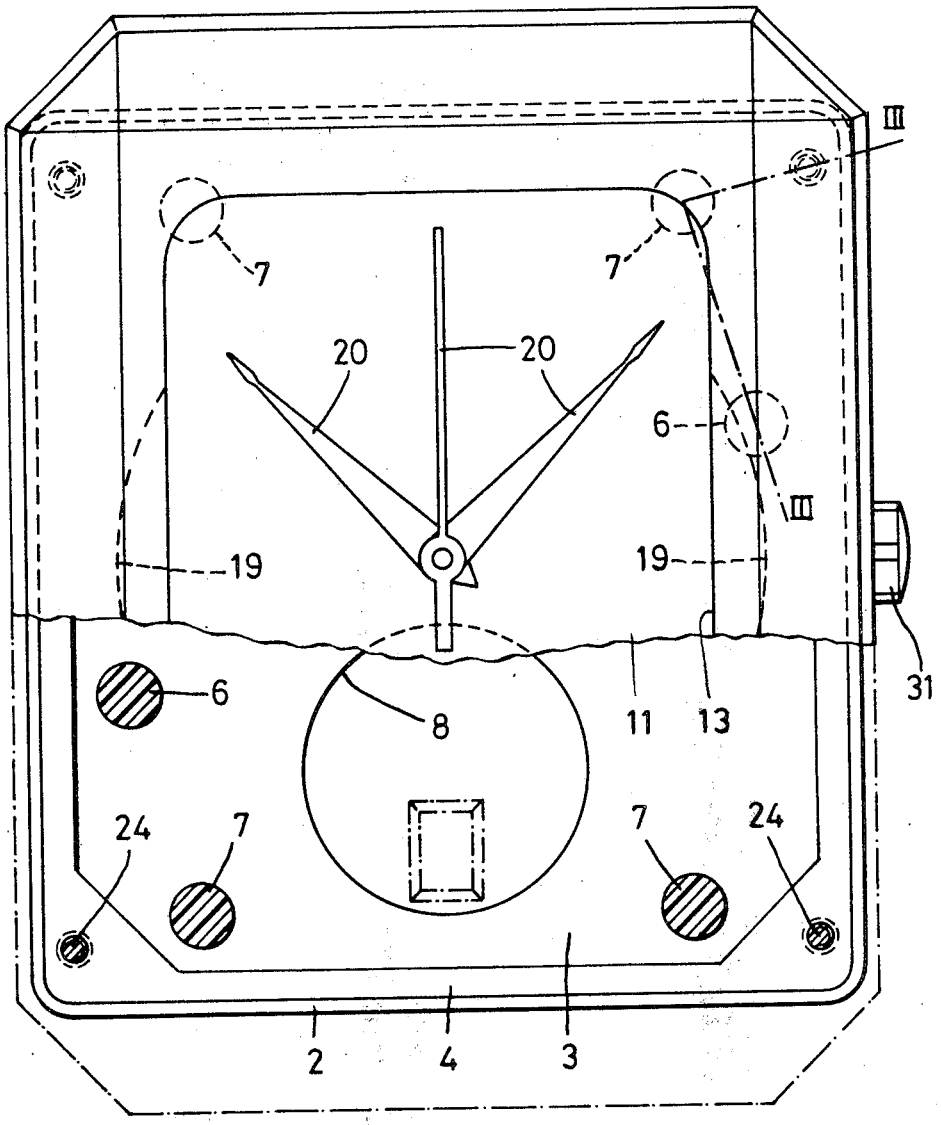
FIG. 2 is a plan view of a watch in which the visible casing parts are the same in both embodiments, some casing parts being torn away and others shown in section along line II—II of FIG. 3.

The wrist-watch casing represented in FIGS. 2 to 4 comprises a caseband 9. Its outer side face 10 is the sole caseband face which has been submitted to fine finishing operations, because it is the only caseband face which is visible on the watch. The upper caseband part is arranged for receiving the glass which is composed of: a sapphire or glass plate 11 wholly covering the upper caseband face; a second sapphire plate 12 glued under plate 11 in an in dissoluble manner and set with force fit in a caseband opening 13 together with a sleeve 14 sealing the gap between the glass and the caseband, and a frame 15 glued under plate 11 in the same manner as plate 12. Frame 15 can consist of a precious or semi-precious stone which will accordingly be visible through the glass plate 11; it can also be made out of a hard metal or even out of a base metal having its upper face finished so as to provide an ornamental design visible through plate 11. Finally, frame 15 can simply consist of a rough piece which would be glued to a metallized coating formed under the peripheral part of plate 11 by evaporation in the vacuum. Such a coating is formed anyway under the portion of plate 11 extending between frame 15 and plate 12 to hide the caseband projection 16 and the sleeve 14. The height of projection 16 is equal to the thickness of frame 15 so that the latter and the zone of plate 11 extending over projection 16 both lie on the caseband 9.

Besides opening 13, the inner caseband wall is shaped so as to provide a lodging 17 for the watch dial 18, cut-outs 19 in the long sides of the casing for the passage of the watch hands 20 and a lodging 21 for the watch movement 22. The contour of lodging 21 is substantially the same as that of the inner wall of rim 4 of layer 3, as shown in particular in FIG. 4, wherein a part of the casing bottom has been torn away. Caseband 9 is still provided with four tapped blind holes 23 in the vicinity of its corners. Finally, the lower face of caseband 9 is flat.

As shown in particular in FIG. 3, the casing bottom is fixed to the caseband by means of screws 24, only one appearing in that FIGURE. The head 25 of every screw is partly embedded in a lodging 26 of bottom piece 1. To establish a first hindrance to infiltrations of all kinds, the lower face 27 of head 25 and the bottom of lodging 26 are polished so as to lie as intimately as possible in contact with each other. Between the head and the threads, each screw 24 is provided with a smooth shaft 28 which passes with some play through bottom piece 1.

When screws 24 are screwed down in the tapped blind holes 23 of the caseband 9, the bent up edges 2 of bottom piece 1 bears against the lower face of caseband 9. For the part of layer 3, its rim 4, which normally extends upwards beyond edges 2 of bottom piece 1, is flattened out by the flat lower caseband face, down to the level of edges 2. In the casing corners, rim 4 is pressed against the shaft portion 28 of screws 24 in order to tightly encompass the same. The height of the rim part projecting above edges 2 of bottom piece 1 is chosen in such a manner that the disclosed flattening produces a tight seal between the bottom and the caseband, however, without producing in rim 4 internal stresses exceeding the limit of elasticity.

FIG. 3 also enhances the function performed by projections 6 and pillars 7. Like that shown in FIG. 3, each pillar 7 is located under a portion of dial 18 which extends radially outwards beyond the outer edge of the watch movement 22 (see also FIG. 4 as well as FIG. 2). Pillars 7 are long enough in order to be able to hold dial 18 in abutting engagement with a shoulder of caseband 9 constituted by the bottom of lodging 17. As regards projections 6, they enter lodgings 29 of the watch movement 22 which are conventionally provided for the usual case-screws by means of which the watch movement 22 is fixed in the casing. Projections 6 take the place of said case-screws which can be dispensed with in this instance. Projections 6 are long and strong enough to hold the movement rim 30 in abutting engagement with a caseband shoulder (not shown) extending in the middle part of the long sides of the casing (FIG. 4, see also FIG. 3 and FIG. 2).

The watch movement 22 intended to be mounted in the disclosed casing is that of a quartz watch. The battery supplying the same is coaxial with the bare part 8 of bottom piece 1 as shown in FIGS. 1 and 2. As a consequence, layer 3 lining the inner face of bottom piece 1 does not at all increase the watch thickness, if one takes into consideration that the battery supplying an electronic watch movement constitutes the thickest element thereof. Moreover, said battery may lie against bottom piece 1 thereby establishing the contact to the ground.

The bottom of the casing according to the invention need not be flat. It could be made in the form of an arch in order to follow the curvature of the wrist, provided that the caseband lower face be identically curved in order that the bent up edges of the metallic bottom piece bear in every point against the caseband, when the casing is closed.

The invention is obviously not limited to casings having the contour represented in the drawing. It can be applied under the same conditions to square, hexagonal, trapezoidal casings and more generally to polygonal casings having curved side faces and even to circular casings. In all the cases, the invention has, indeed, the advantage to considerably simplify the operations required by the insertion and fixation of the watch movement in its casing and by the closure of the latter. Once the glass has been set in place on the caseband, the latter is turned over. Then, it suffices to lay the watch movement carrying the dial and the hands into the caseband, to set the bottom thereabove and, finally, to screw it on the caseband. In case of need, the stem secured to the control knob 31 is set in place and latched in the movement before covering the latter with the bottom.

It will finally be observed that the metallic bottom piece can be made relatively thin, especially if it is made of stainless steel, because of the reinforcing ribs 32 which not only relieve the monotony of a smooth surface, but also allow a welcome air circulation between the wrist and watch to eliminate perspiration.

Figure 5:
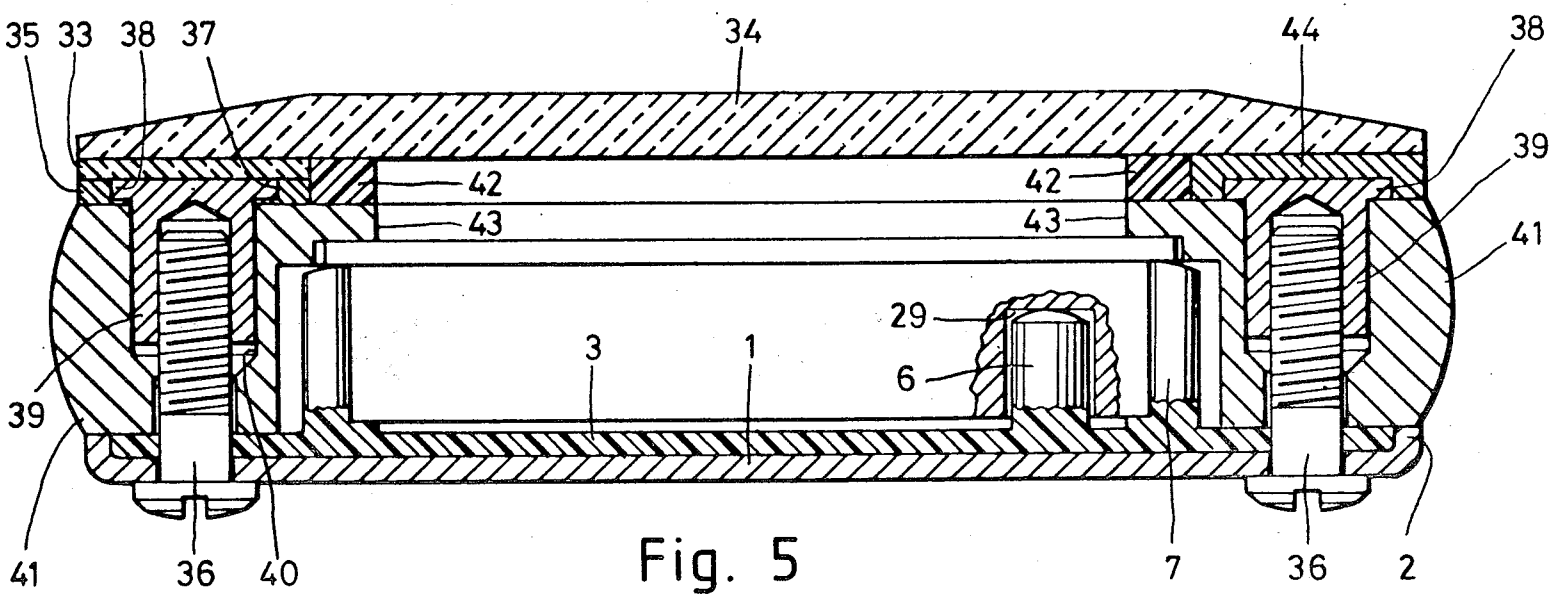
FIG. 5 is a sectional view similar to that of FIG. 3, but showing the second embodiment and a modification.
Figure 6:
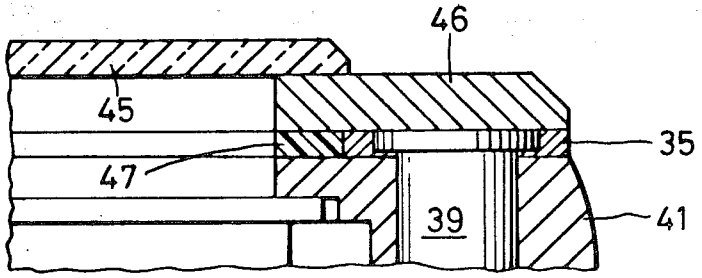
FIG. 6 is a part sectional view similar to that of FIG. 5, but showing a further modification.

The second embodiment and the modifications shown in FIGS. 5 and 6 enable a further manufacturing and mounting simplification which constitutes the subject matter of the patent application filed on the same date by the same Applicant and entitled "Wrist-watch casing". In these cases, the screws fixing the bottom fix at the same time the glass to the caseband.

In the embodiment shown in the left part of FIG. 5, an ornamental frame 33 (precious or semi-precious stone, polished hard metal, base metal finely finished) is glued under the glass 34 and a spacing frame 35 is glued under frame 33. Lodgings 37 are provided in the face glued to frame 33 of frame 35, at places centered on the axis of the fixing screws 36 of bottom 1, 3. Lodgings 37 receive the base collar 38 of tapped sockets 39 extending through bores of frame 35 provided in the center of the bottom of lodgings 37 and entering borings 40 of caseband 41.

Upon screwing down the screws 36 in sockets 39, the caseband is sandwiched between the frame 35 (solid with the glass 34) and the casing bottom 1, 3. In the embodiment represented in the drawing, the gap between the glass and the caseband is sealed by a gasket 42 located inside frames 33 and 35. A metallized zone formed by vaporization in vacuum and being a little larger than gasket 42 is formed under glass 34 to hide said gasket as well as the possible irregularities along the inner edge of frame 33.

In a modification (not shown), frames 33 and 35 could extend inwardly up to the opening 43 of caseband 41 and the watertight gasket be located in a groove of the plane upper face of casing 41 extending under frame 35. In this case, a very narrow metallized glass zone would already hide the possible irregularities of the inner edge of frame 33. The modification represented in the right part of FIG. 5 differs from the embodiment having been just disclosed by the fact that glass 34 carries a single frame 44 at its periphery, which is glued to a thin metallized coating formed under the glass periphery by vaporization in vacuum. In this case the base collar 38 of sockets 39 is welded in a corresponding lodging of frame 44. Here again, frame 44 could extend inwardly up to the edge of opening 43 of caseband 41 and the gasket 42 be located under this frame, in a groove provided in the upper caseband face.

In the modification of FIG. 6, the glass 45 does not wholly cover the visible face of the casing. It is glued on a hard metal frame 46 extending outwardly up to the outer edge of caseband 41. The sockets 39 are made solid with the glass 45 in the same manner as in the embodiment represented in the left half of FIG. 5, namely by means of a spacing frame 35 glued under the hard metal frame 46. Frame 35 is, however, less large than frame 46 in order that the watertight gasket 47 may be located between the hard metal frame and the caseband 41, thereby avoiding any premanent pressure on the glass.

With the casings in which the outer edge of a base metal frame appears on the outer side face of the casing, the latter is not al all spoiled. Said edge can for instance be serrated and protected by a resistant coating, thereby even enhancing the originality of the watch appearance.

When screws 36 are screwed down in sockets 39 the abutting engagement with the upper and lower caseband faces of the lower face of the frames solid with the glass and of the bent up bottom edges 2, respectively, renders any gap therebetween totally invisible, so that the casing appears as if it consisted of a single piece.

The separate manufacture of the bottom, the caseband and the glass, together with all the components solid therewith, as well as their gluing or welding is simple and easy. The tolerances are not critical. To perform the final assemblage of the separately manufactured chief components of the watch, it suffices to carry out the following successive steps: placing the glass on a support in a turned over position, laying the watertight gasket on that glass, inserting the caseband borings onto the sockets solid with the glass, introducing the watch movement into the caseband, setting in place the movement control stem and latching the same, covering the whole with the bottom, while inserting its projections 6 into the corresponding lodgings of the watch movement and screwing down screws 36 until the frames solid with the glass and the bent up bottom edges butt against the caseband. The watertight gaskets are then exactly compressed to the desired extent and they surely stand at the desired place.

What is claimed is:

1. In a watertight wrist-watch casing including a caseband and an independent bottom removably secured to said caseband by means of screws crossing the bottom and causing a gasket of elastomeric material to be compressed between the caseband and the bottom so as to form a tight seal between these two pieces, the arrangement of a bottom comprising an outer metallic piece and a thin elastomer inner layer lining at least the peripheral part of the inner face of said outer metallic piece to which it strongly adheres by a metal/elastomer junction, said screws pressing a portion of said thin layer against the caseband lower face, wherein said metallic bottom piece has its edges bent upwards so as to come in abutting engagement with the lower caseband face, said thin inner layer having an upwardly projecting rim at its periphery being adjacent to said bent up edges of the metallic bottom piece and extending, when at rest, beyond said bent up edges, the part of said rim so extending beyond said bent up edges being flattened out by the caseband lower face down to the level of said bent up edges, when the casing is closed, the amount of said rim which extends beyond said bent up edges, when at rest, being determined so that closing the casing does not generate in said thin layer a stress exceeding its limit of elasticity.

2. In a watertight wrist-watch casing according to claim 1 and being adapted for receiving a watch movement provided with lodgings arranged for receiving case-screws for fixing the movement to the caseband, said thin layer being made integral with cylindrical upward projections being located so as to enter the case-screw lodgings of the watch movement in lieu of the case-screws and being arranged so as to exert an axially directed upward pressure on the watch movement, thereby holding the latter firmly in place in the casing.

3. In the watertight wrist-watch casing according to claim 2 and being arranged for receiving a watch movement carrying a dial extending radially outwards beyond the watch movement edge at least in some places and the caseband being provided with an inner shoulder serving as abutment for the dial, said thin layer being further made integral with pillars being located so as to pass by the side of the watch movement and to press the dial against said caseband shoulder.

4. A watertight wrist-watch casing according to claim 1, wherein the inner face of said metallic bottom piece has a central bare area for the accomodation of some member of the watch movement.

5. A watertight wrist-watch casing according to claim 1, wherein said metallic bottom piece has a polished surface portion extending around every passage provided for a bottom fixing screw and each one of said bottom fixing screws comprises a head having a polished lower face engaging the polished surface portion of the bottom extending around its passage and a polished shaft portion extending between its head and its screw threads, said shaft portion passing with some play through the metallic bottom piece and being tightly encompassed by the flattened out rim of said thin layer.

6. A watertight wrist-watch casing according to claim 1, wherein said wrist-watch casing further comprises a glass, and a boring is provided through said caseband from its lower face to its upper face for each bottom fixing screw, tapped sockets solid with the glass enter said borings of the caseband, and said bottom fixing screws are screwed in said tapped sockets.

* * * * *